US007245278B2

(12) United States Patent
Hu et al.

(10) Patent No.: US 7,245,278 B2
(45) Date of Patent: Jul. 17, 2007

(54) LIGHT EMITTING DEVICE AND METHOD OF DRIVING THEREOF

(75) Inventors: Jen-Yi Hu, Hsinchu (TW); Jung-Chun Tseng, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 509 days.

(21) Appl. No.: 10/800,040

(22) Filed: Mar. 15, 2004

(65) Prior Publication Data

US 2005/0057456 A1 Mar. 17, 2005

Related U.S. Application Data

(60) Provisional application No. 60/502,227, filed on Sep. 12, 2003.

(51) Int. Cl.
*G09G 3/32* (2006.01)
*G09G 3/10* (2006.01)

(52) U.S. Cl. ..... 345/82; 345/76; 345/690; 345/214; 315/169.1; 315/169.2; 315/169.3

(58) Field of Classification Search ..... 345/76–78, 345/80, 82, 211–214, 690; 315/169.1–169.4
See application file for complete search history.

(56) References Cited

U.S. PATENT DOCUMENTS 6,023,259 A 2/2000 Howard et al.
6,515,428 B1 2/2003 Yeh et al.
6,914,390 B2 * 7/2005 Koyama ..... 315/169.3
7,015,882 B2 * 3/2006 Yumoto ..... 345/76
7,042,162 B2 * 5/2006 Yamazaki et al. ..... 315/169.1
7,046,240 B2 * 5/2006 Kimura ..... 345/212
2002/0101171 A1 8/2002 Kao et al.
2002/0135312 A1 9/2002 Koyama
2002/0167471 A1 11/2002 Everitt
2002/0167474 A1 11/2002 Everitt
2002/0195968 A1 12/2002 Sanford et al.
2006/0082524 A1 * 4/2006 Kwon ..... 345/76

FOREIGN PATENT DOCUMENTS

EP 1 130 565 A1 9/2001
EP 1 231 592 A2 8/2002
WO WO 02/071379 A2 9/2002

* cited by examiner

*Primary Examiner*—Henry N. Tran
(74) *Attorney, Agent, or Firm*—Arent Fox LLP

(57) ABSTRACT

A display pixel circuit having a data line loading circuit with a first capacitor, a first reset circuit coupled with the data line loading circuit, and a diode coupled to the data line loading circuit. The display pixel circuit also includes a second capacitor associated with the diode, and a second reset circuit coupled with the second capacitor. The first reset circuit is configured to reset the first capacitor. The second reset circuit is configured to reset the second capacitor, and the diode is driven by a constant current after resetting the first capacitor and the second capacitor.

11 Claims, 2 Drawing Sheets

LIGHT EMITTING DEVICE AND METHOD OF DRIVING THEREOF

CROSS-REFERENCE TO RELATED APPLICATION

This nonprovisional application claims the benefit of pending U.S. Provisional Application Ser. No. 60/502,227, filed on Sep. 12, 2003. The disclosure of the prior application is hereby incorporated herein in its entirety by reference.

BACKGROUND OF THE INVENTION

1. Field of the Invention

The present invention relates to improvements in an organic light emitting display panel having one or more pixel circuits that includes an organic light emitting diode (OLED) disposed within the pixel circuit, and to improvements in methods of driving the organic light emitting display panel. In particular, the present invention provides an improved pixel circuit with respect to the organic light emitting display panel having an improved gray scale, and an improved driving method for optimally driving the pixel circuit for improving the gray scale.

2. Related Art

A cathode ray tube (CRT) has long been the display device for displaying images on a television. In a CRT display, a gun fires a beam of negatively-charged particles (electrons) inside a large glass tube. The electrons excite phosphor atoms along the wide end of the tube, which causes the phosphor atoms to light up. The video image is produced by lighting up different areas of the phosphor coating with different colors at different intensities. Although the CRT has long been used to display video images, it is bulky. In other words, it order to increase the screen width in a CRT display, the length of the tube must be increased as well in order to give the scanning electron gun room to reach all parts of the screen. Consequently, a CRT having a big screen is heavy and takes up a sizeable space.

A liquid-crystal display (LCD) device is another display device for displaying images. In a conventional LCD device, a built-in backlight is either disposed beside or behind the LCD display. This additional built-in backlight causes the LCD display device to be thick and heavy.

Accordingly, the conventional OLED display panel was introduced to overcome some of the drawbacks of the CRT and LCD display devices. Specifically, the conventional OLED display device includes one or more OLED that can spontaneously emit light without the need to have a built-in backlight. In addition, the conventional OLED provides a large and thin display screen with an image quality and performance equal to or superior to the CRT and/or LCD display device.

The conventional OLED display panel employs a voltage driver to directly modulate the gate voltage of a current source transistor by a voltage signal. However, the voltage driven approach encounters problems with respect to the brightness and/or the gray scale of the OLED. Accordingly, there is a need to have an OLED pixel circuit that improves the gray scale as well as improving the brightness of the OLED. In addition, there is also a need to provide a method of employing a current driver to drive currents to the OLED.

SUMMARY OF THE INVENTION

One example of the present invention provides a display pixel circuit having a data line loading circuit with a first capacitor, a first reset circuit coupled with the data line loading circuit, and a diode coupled to the data line loading circuit. The display pixel circuit also includes a second capacitor associated with the diode, and a second reset circuit coupled with the second capacitor. The first reset circuit is configured to reset the first capacitor. The second reset circuit is configured to reset the second capacitor, and the diode is driven by a constant current after resetting the first capacitor and the second capacitor.

In another example, the present invention is directed to a method of driving a display pixel circuit. The method includes the steps of resetting a first capacitor of a data line loading circuit, resetting a second capacitor associated with a diode, and driving the diode with a constant current when the first capacitor and the second capacitor have been reset.

DESCRIPTION OF THE DRAWINGS

The accompanying drawings, which are included to provide a further understanding of the present invention and are incorporated in and constitute a part of this specification, illustrate examples of the present invention and together with the description serve to explain the principles of the present invention.

In the drawings.

DETAILED DESCRIPTION OF THE EXEMPLARY EMBODIMENTS

Reference will now be made in detail to the exemplary embodiments of the present invention, examples of which are illustrated in the accompanying drawings.

The present invention relates to an organic light emitting diode (OLED) pixel circuit employing a current driver to improve the gray scale of an OLED display device, and a method of driving the OLED employing the current driving approach.

Figure 1:
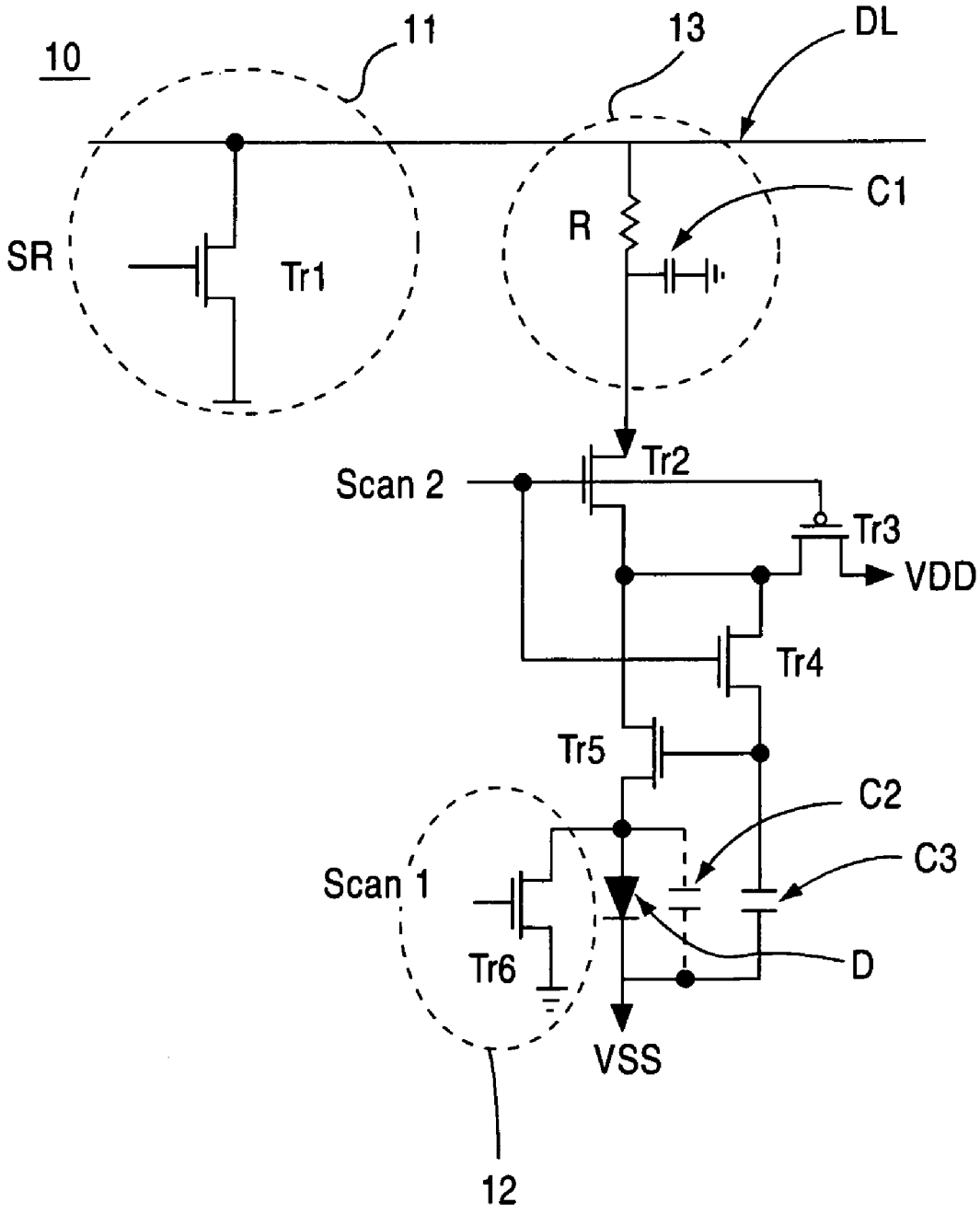
FIG. 1 illustrates a detailed configuration of one example of a pixel circuit 10 of an OLED display panel in accordance with the present invention.

FIG. 1 illustrates a detailed configuration of one example of a pixel circuit 10 of an OLED display panel in accordance with the present invention. In particular, FIG. 1 shows the pixel circuit 10 that employs a current driving approach of the OLED having a reset circuit 11 and a reset circuit 12.

The pixel circuit 10 of FIG. 1 has a data signal line DL, a source signal line SR, and scan lines SCAN 1 and SCAN 2, along with power sources VDD and VSS.

Furthermore, the pixel circuit 10 includes transistors Tr1, Tr2, Tr3, Tr4, Tr5 and Tr6 arranged in a predetermined configuration within the pixel circuit 10. The transistors Tr1, Tr2, Tr3, Tr4, Tr5 and Tr6 may be thin film transistors (TFT). The pixel circuit 10 also includes capacitors C1, C2 and C3, a resistor R and an OLED D.

According to the configuration shown in FIG. 1, the gate electrode of transistor Tr1 is connected to the source signal line SR, and the source region of transistor TR1 is connected to the data signal line DL. This configuration is the first reset circuit 11 of the present invention.

Also, the configuration of FIG. 1 shows a data signal line loading circuit 13 which includes the resistor R connected to the data signal line DL. The resistor R has a predetermined resistance such as 1K Ohms. The resistor R is also connected to the capacitor C1 and the source region of transistor Tr2. The capacitor C1 has a predetermined storage capacitance such as 5pico farad.

FIG. 1 further shows the gate electrode of transistor Tr2, the gate electrode of transistor Tr3, and also the gate electrode of transistor Tr4 connected to scan line SCAN 2. The source region of transistor Tr3 is connected to power source VDD while the drain region of transistor Tr3 is connected to the source region of transistor Tr4 and is also connected to the drain region of transistor Tr2. Transistor Tr2 is a switching transistor and may be n-channel transistor or p-channel transistor.

FIG. 1 also shows a transistor Tr5, a transistor Tr6, an OLED D, a parasitic capacitor C2 and a storage capacitor C3. The OLED D has an anode and a cathode. The gate electrode of transistor Tr5 is connected to the storage capacitor C3 and the drain region of transistor Tr4. The transistor Tr4 is provided to initialize the stored voltage at the storage capacitor C3. Furthermore, the drain region of transistor Tr5 is connected to the OLED D as well as the parasitic capacitor C2. The OLED D is connected to power source VSS at the opposite end.

The gate electrode of transistor Tr6 is connected to scan line SCAN 1 while the source region of transistor Tr6 is connected to the OLED D. This configuration is the second reset circuit 12 of the present invention.

Figure 2:
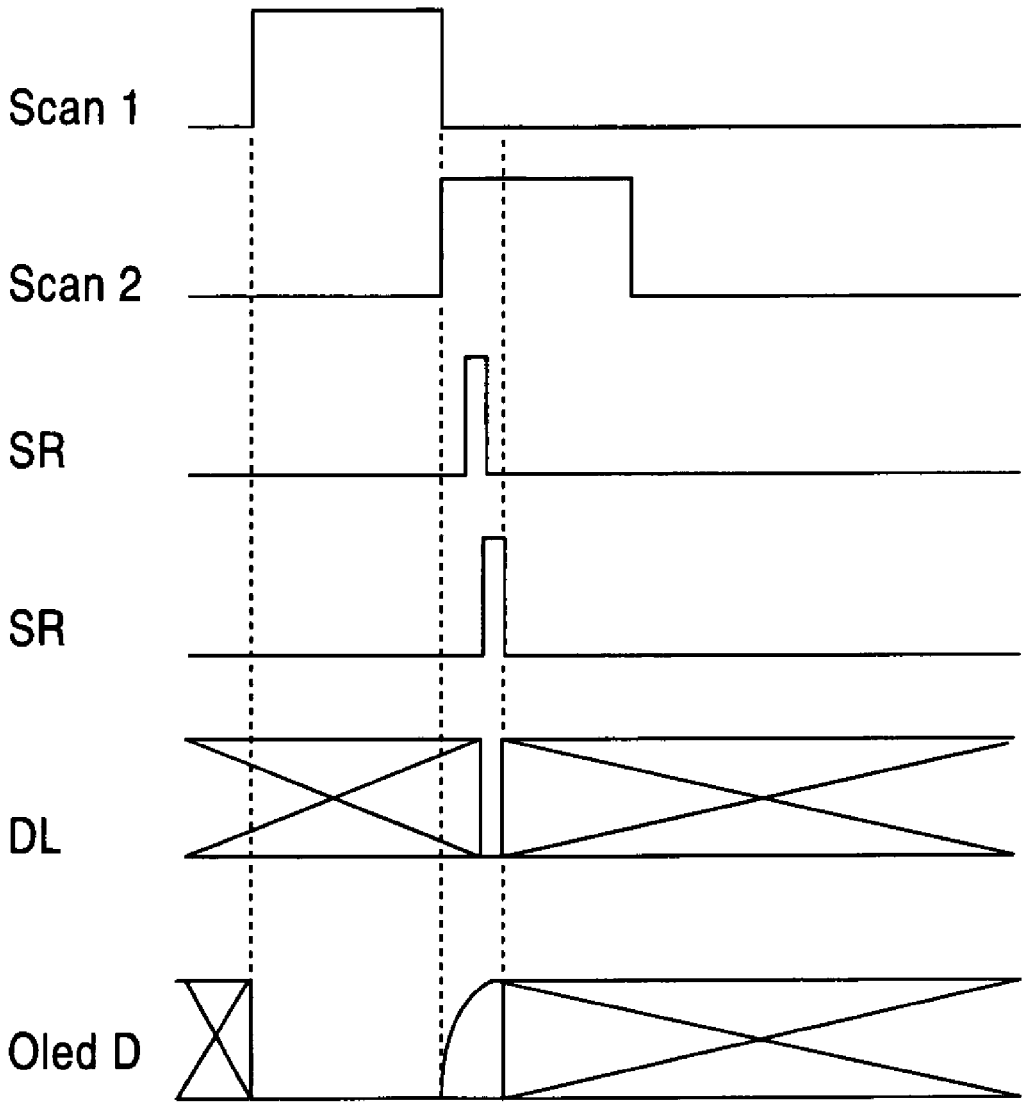
FIG. 2 illustrates a timing chart showing the occurrence of a write period and a display period of a pixel circuit 10 of an OLED display panel in accordance with one example of the present invention.

FIG. 2 illustrates a timing chart showing the occurrence of a write period and a display period of a pixel circuit 10 of an OLED display panel in accordance with the present invention.

In operation, the first reset circuit 11 is turned on before the loading of the data line DL. In other words, before the data line DL is selected and loaded with the data line signal, the source signal line SR sends a signal to transistor Tr1 and opens up the transistor Tr1, which turns on the reset functions of the reset circuit 11. Once the transistor Tr1 is opened by source signal SR, the stored voltage in capacitor C1 of the data line loading circuit is removed since the stored voltage is drained out of the capacitor C1 through the resistor R and to transistor Tr1. As such, before the data is selected, the voltage in the storage capacitor C1 is initialized to zero. Once the reset circuit 11 resets the voltage of the capacitor C1, data line DL signal may be selected for data loading, and voltage can be stored in the capacitor C1 without residual voltage from the previous data line loading.

When scan line SCAN 2 is selected, the scan line signal opens transistor Tr2. Thereafter, the current from the capacitor C1 flows through transistor Tr2 and through transistor Tr5 and is stored in the storage capacitor C3. According to one example of the present invention, the storage capacitor C3 can store an amount of voltage equal to the amount of current flowing thereto. In other words, the amount of voltage stored in the storage capacitor C3 is proportional to the amount current flowing thereto.

When the scan line SCAN 2 is not selected, the transistor Tr2 is closed. As such, the voltage at the region between the drain region of Tr3 and the source region of Tr4 is used to drive the stored current in storage capacitor C3 through the gate electrode and the drain region of the transistor Tr5 to the OLED D. According to the present invention, the amount of current flowing to the parasitic capacitor C2 and the OLED D is the same amount of the current flowing to the storage capacitor C3.

When the scan line SCAN 1 is selected, transistor Tr6 is opened and the second reset circuit 12 of the present invention is turned on. Once the transistor Tr6 is opened, the residual stored voltage in the parasitic capacitor C2 is removed since the residual stored voltage is drained out of the capacitor C2 to transistor Tr6. As such, before the current is driven to the OLED D, the residual voltage in the parasitic capacitor C2 is initialized to zero. Once the reset circuit 12 resets the voltage of the capacitor C2, an amount of voltage equal to the amount of voltage stored in the storage capacitor C3 can be stored in the parasitic capacitor C2 without residual voltage from the previous data loading. Therefore, a constant current flowing from the parasitic capacitor C2 can drive the OLED D.

It will be apparent those skilled in the art that various modifications and variations can be made to the OLED pixel circuit of the present invention without departing from the spirit or scope of the invention. Thus, it is intended that the present invention cover the modifications and variations of this invention provided they come within the scope of the appended claims and their equivalents.

We claim:

1. A display pixel circuit comprising:

a data line loading circuit having a first capacitor;

a first reset circuit coupled with the data line loading circuit;

a diode coupled to the data line loading circuit;

a second capacitor associated with the diode; and a second reset circuit coupled with the second capacitor, wherein the first reset circuit is configured to reset the first capacitor, wherein the second reset circuit is configured to reset the second capacitor, and wherein the diode is driven by a constant current after resetting the first capacitor and the second capacitor.

2. The display pixel circuit of claim 1, further comprising:

a plurality of transistors coupled to the diode;

and a third capacitor coupled to the diode.

3. The display pixel circuit of claim 2, wherein the third capacitor is a storage capacitor for receiving a current from the first capacitor.

4. The display pixel circuit of claim 1, wherein the diode comprises an organic light emitting diode.

5. The display pixel circuit of claim 1, wherein the first reset circuit comprises a first reset transistor connected to a signal line.

6. The display pixel circuit of claim 1, wherein the first reset circuit comprises a reset transistor connected to a signal line, the first reset transistor initializes a voltage of the first capacitor to a predetermined volt.

7. The display pixel circuit of claim 1, wherein the second reset circuit comprises a reset transistor connected to a scan line, the reset transistor initializes a voltage of the second capacitor to a predetermined volt.

8. A method of driving a display pixel circuit, comprising the steps of:

resetting a first capacitor of a data line loading circuit;

resetting a second capacitor associated with a diode; and driving the diode with a constant current when the first capacitor and the second capacitor have been reset.

9. The method of claim 8, wherein the step of resetting the first capacitor comprises the steps of:

selecting a signal line;

activating a reset circuit; and initializing a voltage of the first capacitor to a predetermined volt.

10. The method of claim 8, wherein the step of resetting the second capacitor comprises the steps of:

selecting a scan line;

activating a reset circuit; and initializing a voltage of the second capacitor to a predetermined volt.

11. The method of claim 8, wherein the step of driving the diode comprises the steps of:

selecting a data line for data loading;

storing a first voltage in the first capacitor after resetting thereof;

activating a plurality of transistors;

storing a second voltage in a third capacitor;

deactivating the plurality of transistors; and charging the second capacitor with the second voltage after resetting the second capacitor.

* * * * *